United States Patent [19]

Doty, Jr.

[11] Patent Number: 4,658,266

[45] Date of Patent: Apr. 14, 1987

[54] VERTICAL ANTENNA WITH IMPROVED ARTIFICIAL GROUND SYSTEM

[76] Inventor: Archibald C. Doty, Jr., Jackson Rd., Rte. 3, Box 126, Fletcher, N.C. 28732

[21] Appl. No.: 541,587

[22] Filed: Oct. 13, 1983

[51] Int. Cl.[4] ..... H01Q 1/48

[52] U.S. Cl. ..... 343/848; 343/846; 343/829

[58] Field of Search ..... 343/846–848, 343/829, 830, 745, 749, 711, 712

[56] References Cited

U.S. PATENT DOCUMENTS 2,008,931 7/1935 Schuler ..... 343/847
4,184,160 1/1980 Affronti ..... 343/712

OTHER PUBLICATIONS

Roberts, "Input Impedance of a Folded Dipole", RCA Review, Jun. 1947, pp. 289–300.
ARRL Antenna Book, Published by the ARRL, Newington, Conn., 14th Edition, 1983, pp. 8–15 to 8–16.
NRI Communications Text, CC210, National Radio Institute, Wash., D.C., 1976, pp. CC210–20 to CC210–21.
Miller, "Modern Electronic Communication", Prentice-Hall, Englewood Cliffs, N.J., 1978, pp. 412–413.

*Primary Examiner*—Eli Lieberman
*Assistant Examiner*—Michael C. Wimer
*Attorney, Agent, or Firm*—Mills and Coats

[57] ABSTRACT

The present invention relates to vertical antenna systems employing an improved artificial ground system. In a low frequency design, the artificial ground system provided is in the form of a counterpoise or ground screen that is provided with an efficient, economical and practical electrical radial wire design. A high frequency design is also provided in the form of an integral antenna structure. This high frequency integral design entails a vertical antenna, a counterpoise in the form of a metal plate, a ground plate, and wherein said metal plate forming the counterpoise is insulated from the ground plate. In either type of antenna system, the counterpoise functions to collect antenna return currents and direct them back to the feed point of the antenna in an efficient and effective manner.

2 Claims, 6 Drawing Figures

VERTICAL ANTENNA WITH IMPROVED ARTIFICIAL GROUND SYSTEM

FIELD OF INVENTION

The present invention relates to antenna systems, and more particularly to vertical antenna systems employing artificial ground means in the form of either a counterpoise or ground screen.

BACKGROUND OF INVENTION

The efficient operation of a vertical antenna for transmitting or receiving requires that the antenna be used in conjunction with a "ground". The type, size, physical construction and electrical characteristics of the choosen "ground" determine the performance, efficiency, ease of feed and radiation pattern of the antenna system.

Basically there are two requirements for a good "ground". First, the ground must provide a low resistance path for the return of those currents resulting from the radiated field of the antenna. This is of particular importance at the base of the antenna where the return currents are concentrated. Current flow through the relatively high ground resistance in this area can result in severe and substantial ($I^2R$) heat losses.

Secondly, a good ground system should provide a good electrically reflecting plane to allow the creation of the so called "image antenna". This increases the signal radiated by the antenna and assures that it is transmitted or received at the desired radiation angle.

Conventional vertical antennas that use the earth as a ground do not provide sufficient and optimum performance. This is because the earth is a relatively poor electrical conductor at low frequencies such as those used by AM broadcast stations and acts as a dielectric or insulator at high frequencies such as used by land mobile radio stations, citizens band radio service, and the higher amateur radio bands.

As opposed to using the earth as a sole "ground" source, it has been known to use artificial ground systems in conjunction with vertical antennas. There is no doubt, that artificial ground systems do improve the operational efficiency and performance of vertical antennas.

The most commonly used artificial ground system comprises a system of buried electrical wires that radiate outwardly from the base of a vertical antenna. Antenna return currents flow back towards the base of the antenna along these wires instead of flowing through the adjacent high resistance earth. Research conducted in the past, particularly that reported in 1937 by George H. Brown, determined that for optimum results one should use 120 or more radial wires with each being at least one-fourth wavelength long relative to the operating frequency of the antenna system. In fact, this very recommendation is a requirement of the Federal Communications Commission for AM broadcast stations today.

It is appreciated that buried wires provided over a substantial area of the earth can be very expensive and time consuming to install. In view of this, an artificial ground system referred to as a "counterpoise" has been occasionally used in the past. A counterpoise is an artificial ground system comprising a series of radial wires or other forms of electrical conducting material that is disposed above the earth as contrasted to being disposed below the earth.

Construction problems associated with providing counterpoises have precluded extensive use of the systems, particularly in low frequency applications. Prior to Applicant's invention and the research and development work associated therewith, there was little, if any, data or information concerning the electrical and performance characteristics and properties of the counterpoise. Because of the absence of this data, technology and information, it has been dificult for individuals to design a reliable counterpoise artificial ground system based on existing design criteria and perameters.

It should also be pointed out that the so called "ground screen" has also been occasionally used as an artificial ground system. The "ground screen" may be physically similar to a counterpoise, but is designed such that its wires are grounded to the earth. Ground screens are typically used in a fashion where the wires are buried until they reach the vicinity of the antenna at which time the wires extend up above ground level to form the ground screen. Again, as in the case with the counterpoise, there was very little, if any, prior information and literature available concerning electrical performance characteristics of the ground screen.

SUMMARY AND OBJECTS OF THE PRESENT INVENTION

The present invention entails a vertical antenna having a very efficient artificial ground system that is generally referred to as a counterpoise, or in some cases as a "ground screen" where there is a direct attachment to the earth. Of particular importance and significance is the fact that the artificial ground system of the present invention is derived from and based on a substantial research and testing directed at identifying and defining important design criteria and perameters useful in designing various types of artificial ground systems for antennas. In addition, the present invention presents a number of antenna designs with artificial ground systems for a wide range of frequencies.

It is therefore an object of the present invention to provide a vertical antenna with an improved artificial ground system in the form of a counterpoise or ground screen.

Another object of the present invention resides in the provision of a vertical antenna with an improved counterpoise for intercepting a majority of the antenna return currents before they reach the earth and for returning the intercepted return currents back to the feed point of the antenna in a very efficient manner.

It is also an object of the present invention to provide specific design criteria and perameters for a counterpoise or ground screen design that results in a relatively low level of current flow near the base of the antenna, thereby avoiding substantial (heat) losses customarily found in prior ground systems utilizing buried non-insulated wires.

It is a further object of the present invention to provide a vertical antenna system and design wherein a counterpoise is provided and as provided forms an integral part of the vertical antenna system.

A further object of the present invention resides in the provision of a vertical antenna system wherein the base impedence is determined by the antenna design selected to work with the counterpoise element and is not directly dependent on the size, type and location of the earth or ground system underlying the antenna.

Still a further object of the present invention resides in the provision of a resonant free counterpoise so as to not adversely effect the performance of an associated antenna.

It is also an object of the present invention to provide a vertical antenna system with a counterpoise wherein the resulting angle of radiation from the antenna is both predictable and consistent and is independent of the conductivity of the ground under the antenna.

Another object of the present invention is to provide an antenna system with a very efficient artificial ground system in order that the height of the vertical antenna can be reduced and minimized without unduly effecting or distracting from the efficiency of the antenna system.

A further object of the present invention is to provide a vertical antenna system of the character referred to above that is designed such that the design lends itself to be constructed with excellent physical integrity.

It is also an object of the present invention to provide a vertical antenna with an artificial ground that is particularly suited for use in mobile installations.

Another object of the present invention resides in the provision of a vertical antenna system and artificial ground therefore of the character referred to above that utilizes a counterpoise and ground plate wherein both said counterpoise and ground plate are used for both transmitting and receiving.

Still a further object of the present invention is to provide an artificial ground system for an antenna system that is of such high efficiency that the type and size of the particular antenna is of less importance than with conventional antenna system designs.

It is also an object of the present invention to provide a vertical antenna with an artificial ground system that is adaptable for use in a wide range of frequency applications such as an installation covering a number of acres for an AM broadcast station or for use with an antenna only a few inches high for land mobile units.

Still a further object of the present invention resides in the provision of a vertical antenna and artificial ground system of a design that is particularly suited for use wherein two or more identical antennas are connected to a common transmitter in such a phase relationship as to form specific radiation pattern.

Another object of the present invention resides in the provision of a vertical antenna and artificial ground system specifically designed to collect return currents from a vertical antenna as displacement currents rather than as conduction currents.

Other objects and advantages of the present invention will become apparent from a study of the following description and the accompanying drawings which are merely illustrative of the present invention.

VERTICAL ANTENNA SYSTEM WITH IMPROVED COUNTERPOISE OR GROUND SCREEN

With further reference to the drawings, particularly FIGS. 1 through 4, there is shown therein a vertical antenna system of the type that can be used by AM broadcast stations. The antenna system shown herein is particularly designed for relatively low frequencies, i.e. 30 MHz and less.

Figure 1:
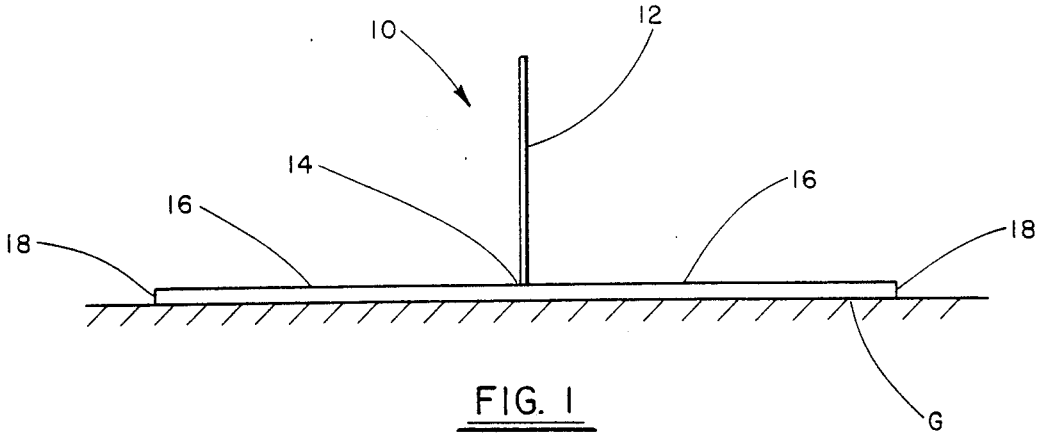
FIG. 1 is an illustration, as viewed from the side, of a low frequency antenna system having a counterpoise design provided in accordance with the present invention.

Viewing the vertical antenna system shown in FIG. 1, it is seen that the entire vertical antenna system is indicated generally by the numeral 10 and as illustrated herein extends over the earth or ground G. Vertical antenna system 10 includes a vertical antenna 12 that extends upwardly from the ground a selected height. Antenna 12 is preferably supported by a support structure such as a concrete pier and is insulated therefrom. The height of antenna 12 may preferably range from approximately one-fourth wavelength to five-eighths wavelength.

Shorter antennas are generally acceptable, but slightly less efficient. Antennas higher than five-eights wavelength radiate at an angle that is often unsatisfactory for most communication purposes.

Extending radially from the base of antenna 12 is an artificial ground system in the form of a counterpoise. In the designs illustrated in FIGS. 2 through 4, the artificial ground system or counterpoise includes a series of radial insulated wires 16. As seen in the drawings, it is preferable that the wires extend above ground G and be insulated therefrom. If the wires are located on or slightly under the surface of the earth they must be coated with an insulating substance, or insulated from the earth by other means. In the case of the design illustrated in FIG. 1, the respective radial wires 16 are elevated above ground and extend from the base of antenna 12 to an outer periphery of the counterpoise. To support the radial wires 16, there is provided a series of support structures 18 radially spaced from antenna 12 and extending upwardly from the ground G at select distances. It is important that the respective radial wires 16 comprising the counterpoise be insulated at the point that they are connected to the respective supports 18. It is again noted that the radial wires 16 are insulated and that they may be spaced at any appropriate and convenient distance above the ground, or may be slightly below the surface of the earth so long as they are insulated from the earth.

For optimum performance, it has been determined that the length of each respective radial wire 16 should be at least 0.20 wavelength long. In the case of a low frequency (as 1300 KHz) AM broadcast station, one would expect this distance to be about 150 feet.

Also, to make the vertical antenna systems practical, economical, and efficient, for a low frequency AM Broadcast station, it has been found through research and testing that the minimum number of radials should be approximately 40 to 50 and should generally be equally spaced as they extend outwardly from the base of antenna 12.

Radials 16 should be interconnected about inner ends by an inner connecting wire 20. Likewise, radials 16 should be interconnected about their outer ends by an outer connector 22.

Defined between inner connector 20 and the base of antenna 12 is a feed point 14. It is appreciated that this feed point 14 is adapted to be operatively connected to a conventional transmitter in such a fashion that a transmitter effectively interconnects antenna 12 with the counterpoise comprised of the plurality of insulated radial wires 16.

At this point, it should be pointed out that the artificial ground system of the present invention may be designed in the form of a "ground screen". A ground screen is physically similar to a counterpoise except that the same has its wire grounded to the earth. In the past, it has been conventional practice to provide a ground screen in conjunction with buried radial wires. In such cases, it has been common for the wires to be buried until they reach the vicinity of the antenna at which time they are directed upwardly above ground level as a ground screen.

Figure 6:
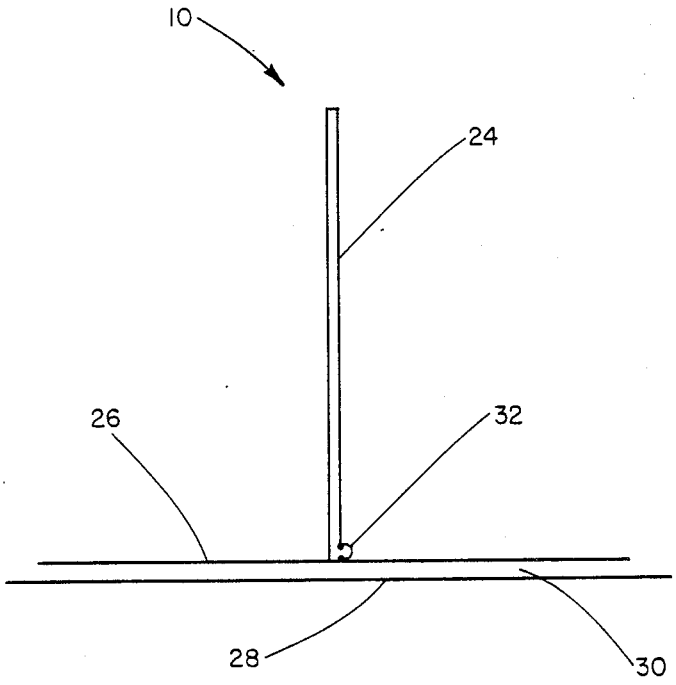
FIG. 6 is a side elevational view of a folded unipole type of vertical antenna system having a counterpoise constructed in accordance with the present invention.

With reference to FIG. 6, there is shown a variation of the vertical antenna system of the present invention. In particular, the vertical antenna system shown therein is of a folded unipole type and includes a folded unipole antenna 24 of approximately one-fourth wavelength in height with one or more parallel drop wires of generally the same length or height. It should be pointed out that if more than one drop wire is utilized, that the plurality of wires should be connected at the lower ends. This type of radiator is particularly attractive inasmuch as its base impedance depends on the ratio of diameters of the vertical radiator and the drop wire to the number and configuration of the drop wires.

Operatively associated with the folded unipole antenna 24 is a counterpoise or artificial ground 26. Preferably counterpoise 26 is symmetrical in shape and can be constructed from metallic radial wires, rods, mesh or even a solid plate. The smallest dimension from the antenna to the periphery of the counterpoise 26 should preferably be more than 0.20 wavelength long at the operating frequency of the antenna system.

As discussed hereinabove, the purpose of counterpoise 26 is to collect return currents directed from the antenna 24 and to a limited degree from a ground plate or ground 28 disposed below counterpoise 26. The importance of the counterpoise extending at least 0.20 wavelength from the antenna 24 cannot be over emphasized. Research and testing indicates that this dimension will reduce the concentration of current at the base of the antenna 24 and consequently will reduce (heat) losses. As referred to above, the vertical antenna system disclosed in FIG. 6 includes a ground plate 28 that is spaced from counterpoise 26 by an insulating space 30. Insulating space 30 establishes a capacitive relationship between counterpoise 26 and ground plate 28. Ground plate 28 may be composed of wires, metal mesh, or even a solid ground plate. The size and dimension of ground plate 28 should be at least equal to or greater than that of the counterpoise 26. It should be pointed out that any metallic portion of an object may be used as the ground plate 28. For example, the roof of an automobile could be used in certain land based mobile applications depending on the frequency and application of the antenna system.

A vertical antenna system 10 can be provided of the same basic design referred to and discussed with respect to the folded unipole antenna in FIG. 6 with the exception that a single vertical radiator is used. In such a case, the feed impedence is fixed and the flexibility of designing the desired impedence that is found with a design such as shown in FIG. 6 is lost.

Figure 5:
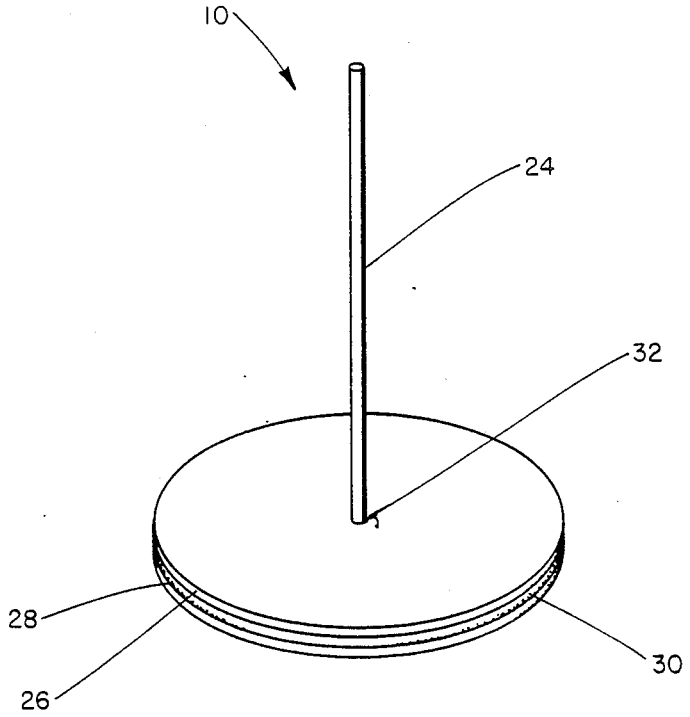
FIG. 5 illustrates an integral high frequency vertical antenna system having a counterpoise and ground plate constructed in accordance with the present invention.
Figure 2:
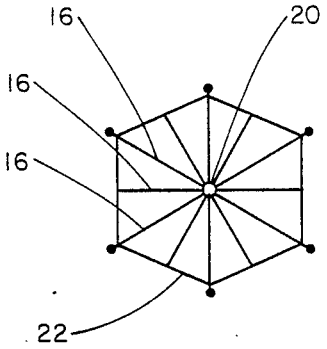
FIG. 2 is a top plan view of an antenna system designed in accordance with the present invention particularly illustrating a first counterpoise radial wire pattern.
Figure 3:
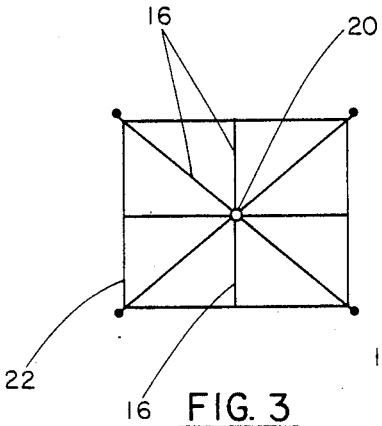
FIG. 3 is a top plan view of the same antenna system particularly illustrating a second counterpoise radial wire pattern.
Figure 4:
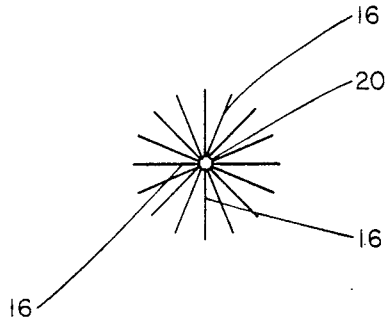
FIG. 4 is a top plan view of the same antenna system particularly illustrating a third counterpoise radial wire pattern.

FIG. 5 shows such a design. Here the single radiator type of vertical antenna system is of an integral construction and design. More particularly, the vertical antenna 24 extends upwardly from cylindrical metal plate 26 that forms the counterpoise. An insulating member 30, formed of rubber or some other similar insulating material, is secured to the bottom of counterpoise 26. Secured to the bottom of insulating member 30 is a ground plate 28. As with the design shown in FIG. 6, the design illustrated in FIG. 5 would also include a feed point 32 that is adapted to be connected to a conventional transmitter.

The design illustrated in FIG. 5 is contemplated to be especially useful in high frequency situations, for example applications above 30 MHz. It is anticipated that this type of antenna design would be effective and efficient in "Land Mobile" use applications at approximately 900 MHz.

Table I which follows, shows typical dimensions for the vertical antenna systems described hereinabove. These dimensions of the antenna element may be reduced through the use of inductive or capacitive loading of the vertical radiator. It is known that such loading enables the physical size of the radiator to be reduced while maintaining its resonant frequency.

TABLE I

TYPICAL ANTENNA SYSTEM DIMENSIONS-VERTICAL ANTENNA AND ARTIFICIAL GROUND

| OPERATING FREQUENCY | RADIO SERVICE | ANTENNA HEIGHT FEET-(Wavelength) | COUNTERPOISE Diameter | COUNTERPOISE Height |
|---|---|---|---|---|
| 1.8 MHZ. | Amateur | 53'($\frac{1}{8}$) to 133'($\frac{1}{4}$) | 212' | 8' |
| 27.2 | Citizens | 9'($\frac{1}{4}$) to 22.6'($\frac{5}{8}$) | 14.5' | 6" |
| 52.0 | Land Mob. | 4.7'($\frac{1}{4}$) to 11.8'($\frac{5}{8}$) | 7.6' | 4" |
| 146.0 | Amateur | 1.7'($\frac{1}{4}$) to 4.2'($\frac{5}{8}$) | 2.7' | 2" |
| 436.0 | Land Mob. | 7"($\frac{1}{4}$) to 17"($\frac{5}{8}$) | 11" | $\frac{1}{2}$" |
| 900.0 | Land Mob. | 3.3"($\frac{1}{4}$) to 8.2"($\frac{5}{8}$) | 5.2" | $\frac{1}{4}$" |

It is noted that two or more identical antenna systems of the present invention can be connected to a transmitter in a phase relationship so as to form a specific design radiation pattern. This is commonly done with standard AM broadcast stations. Also, directive parasitic arrays can be formed from arrays of two or more antennas. Here $\frac{1}{4}$ wavelength vertical antennas are used—electrically—as half of a $\frac{1}{2}$ wavelength dipole element. The second half of the dipole is created by the "image antenna" that results from the excellent characteristics of the counterpoise or ground screen. In this configuration, one antenna system is the basic radiating antenna while the other or others are tuned to act as parasitic directors or reflectors.

From the foregoing discussion and specification, it is appreciated that the present invention presents a very efficient and effective vertical antenna system having an artificial ground that may be in the form of a counterpoise or a ground screen. Of particular importance with respect to the present invention is the great deal of research and testing conducted by Applicant in order to establish optimum design criteria for the counterpoise or ground screen. The design described and shown herein for the artificial ground system was reached after much research and testing. By applying these findings as discussed herein, one can produce a very economical and efficient vertical antenna system with an artificial ground. Further, it is appreciated that the present invention and the improved artificial ground system disclosed herein, is adaptable for use with a wide range of operating frequencies.

The present invention, may of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. An improved vertical antenna and artificial ground system comprising: a folded unipole antenna fed at one end and terminating in a first ground plane means at the other end, said first ground plane means comprising an array of radial wires extending from said terminating end; and a second ground plane means spaced below and closely capacitively coupled to said first ground plane means, said second ground plane means extending at least to the periphery of said first ground plane means.

2. The antenna and artificial ground means of claim 1 wherein said second ground plane means extends beyond the periphery of said first ground plane means.

* * * * *